US006116355A

United States Patent [19]

Thorp et al.

[11] Patent Number: 6,116,355

[45] **Date of Patent: *Sep. 12, 2000**

[54] CHOKE DEVICE

[75] Inventors: Richard Edward Thorp, Frampton-Cotterell; Graham Watson, Frampton-on-Severn, both of United Kingdom; Douglas Caraway, Kingwood, Tex.

[73] Assignee: Camco Drilling Group Limited of Hycalog, Stonehouse, United Kingdom

[ * ] Notice: This patent is subject to a terminal disclaimer.

[21] Appl. No.: 08/898,055

[22] Filed: Jul. 22, 1997

Related U.S. Application Data

[63] Continuation-in-part of application No. 08/689,632, Aug. 13, 1996, Pat. No. 5,673,763, which is a continuation of application No. 08/455,270, May 31, 1995, Pat. No. 5,553,679.

[30] Foreign Application Priority Data

Jun. 4, 1994 [GB] United Kingdom ..... 9411228

[51] Int. Cl.[7] ..... E21B 7/08

[52] U.S. Cl. ..... 175/73; 175/61

[58] Field of Search ..... 175/61, 62, 73, 175/75, 324, 393

[56] References Cited

U.S. PATENT DOCUMENTS 5,673,763 10/1997 Thorp ..... 175/58

FOREIGN PATENT DOCUMENTS 2257182 1/1993 United Kingdom .
2259316 3/1993 United Kingdom .

*Primary Examiner*—William Neuder
*Attorney, Agent, or Firm*—Fletcher, Yoder & Van Someren

[57] ABSTRACT

A choke device for controlling fluid flow, particularly in a modulated bias unit, drill bit or other item downhole drilling component, comprises a passage for the flow of fluid, a choke aperture separating an upstream portion of the passage from a downstream portion thereof, and an impingement surface located in the downstream portion of the passage opposite and spaced from the choke aperture, so that fluid flowing through the choke aperture impinges on the impingement surface. The impingement surface is formed from superhard material, such as polycrystalline diamond, and may comprise the front facing table of a two-layer polycrystalline diamond compact of the kind used as cutting elements in drag-type drill bits.

17 Claims, 3 Drawing Sheets

CHOKE DEVICE

This is a continuation-in-part of U.S. Ser. No. 08/689,632, Filed Aug. 13, 1996, which issued as U.S. Pat. No. 5,673,763 on Oct. 7, 1997, which is a continuation of U.S. application Ser. No. 455,270, filed May 31, 1995, which issued as U.S. Pat. No. 5,553,679 on Sep. 10, 1996.

BACKGROUND OF THE INVENTION

1. Field of the Invention

When drilling or coring holes in subsurface formations, it is often desirable to be able to vary and control the direction of drilling, for example to direct the borehole towards a desirable target or to control the direction horizontally within the payzone once the target has been reached. It may also be desirable to correct for deviations from the desired direction when drilling a straight hole, or to control the direction of the hole to avoid obstacles.

2. Description of Related Art.

The two basic means of drilling a borehole are rotary drilling, in which the drill bit is connected to a drill string which is rotatably driven from the surface, and systems where the drill bit is rotated by a downhole motor, either a turbine or a positive displacement motor. Hitherto, fully controllable directional drilling has normally required the use of a downhole motor, and there are a number of well known methods for controlling the drilling direction using such a system.

However, although such downhole motor arrangements allow accurately controlled directional drilling to be achieved, there are reasons why rotary drilling is to be preferred. For example, steered motor drilling requires accurate positioning of the motor in a required rotational orientation, and difficulty may be experienced in this due, for example, to drag and to wind-up in the drill string. Accordingly, some attention has been given to arrangements for achieving a fully steerable rotary drilling system.

For example, British Patent Specification No. 2259316 describes various arrangements in which there is associated with the rotary drill bit a modulated bias unit. The bias unit comprises a number of hydraulic actuators spaced apart around the periphery of the unit, each having a movable thrust member which is hydraulically displaceable outwardly for engagement with the formation of the borehole being drilled. Each actuator has an inlet passage for connection to a source of drilling fluid under pressure and an outlet passage for communication with the annulus. A selector control valve connects the inlet passages in succession to the source of fluid under pressure, as the bias unit rotates. The valve serves to modulate the fluid pressure supplied to each actuator in synchronism with rotation of the drill bit, and in selected phase relation thereto whereby, as the drill bit rotates, each movable thrust member is displaced outwardly at the same selected rotational position so as to bias the drill bit laterally and thus control the direction of drilling.

As will be described, the outlet means may comprise a choke aperture communicating with a cavity in the thrust member, and at least one continuation passage extending from the cavity to said region where the formation-engaging member overlies the thrust member, there being provided in the cavity, opposite said choke aperture, an impingement surface formed from superhard material.

SUMMARY OF THE INVENTION

The invention provides a choke device for controlling fluid flow comprising a main body formed with a cavity, a choke aperture communicating with said cavity, and at least one outlet passage extending from the cavity, there being provided in the cavity, opposite said choke aperture, an impingement surface formed from superhard material.

The superhard material is preferably polycrystalline diamond, but may also be cubic boron nitride or amorphous diamond-like carbon (ADLC).

Said outlet passage may extend laterally away from the cavity at an angle to the direction of flow of fluid through the choke aperture, and at a location adjacent said impingement surface.

The main body of the choke device may incorporate a polycrystalline diamond compact comprising a front table of polycrystalline diamond bonded to a substrate of less hard material, the compact being so located and orientated in the main body that the front table thereof provides said impingement surface opposite the choke aperture.

The invention also provides a choke device for controlling fluid flow, comprising a passage for the flow of fluid, a choke aperture separating an upstream portion of the passage from a downstream portion thereof, and an impingement surface located in the downstream portion of the passage opposite and spaced from the choke aperture, whereby fluid flowing through the choke aperture impinges on the impingement surface, the impingement surface being formed from superhard material.

The impingement surface may be substantially flat, and may be of generally corresponding shape to the choke aperture. For example, the choke aperture and impingement surface may be both generally circular.

The impingement surface may be shaped to provide a central region which is nearest the choke aperture, and surrounding regions which extend in the downstream direction away from the central region. For example, the impingement surface may be substantially part-conical.

The passage for the flow of fluid may include a plurality of choke apertures spaced apart along the passage, an impingement surface being spaced downstream from each choke aperture. Each choke aperture may be displaced laterally with respect to an adjacent choke aperture, whereby fluid flow from one choke aperture to the next necessitates flow in a direction having a lateral component.

The internal surface of the passage downstream of the choke aperture, and in the vicinity of the impingement surface, may be lined with an abrasion- or erosion-resistant material, such as polycrystalline diamond or tungsten carbide.

The invention further provides a rotary drill bit for drilling holes in subsurface formations, comprising a main bit body carrying a plurality of cutters for cutting the formation being drilled, and at least one internal passage in the bit body to convey drilling fluid to the cutters, said internal passage incorporating a choke device including a choke aperture separating an upstream portion of the passage from a downstream portion thereof, and an impingement surface located in the downstream portion of the passage opposite and spaced from the choke aperture, whereby fluid flowing through the choke aperture impinges on the impingement surface, the impingement surface being formed from superhard material.

The drill bit may include a main internal passage in the bit body, and a plurality of subsidiary passages leading from the main passage to convey drilling fluid to cutters on the bit body, the choke device being located in the main passage downstream of at least one subsidiary passage.

DETAILED DESCRIPTION OF THE PREFERRED EMBODIMENT

Figure 1:
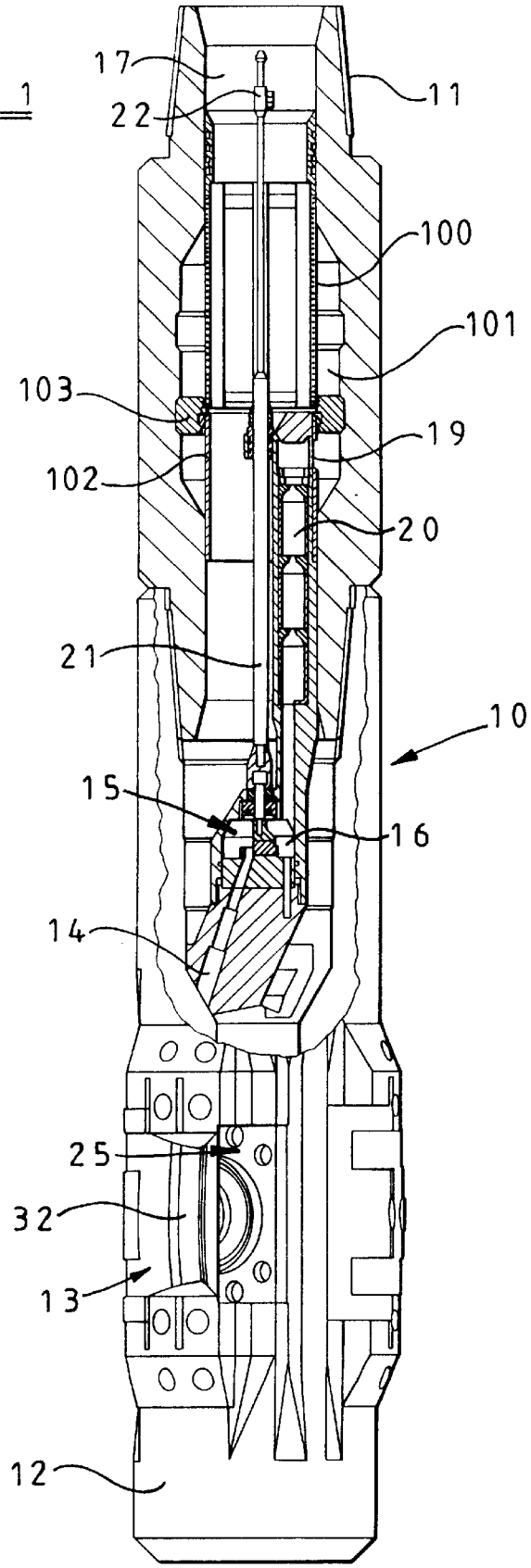
FIG. 1 is a part longitudinal section, part side elevation of a modulated bias unit incorporating a choke device in accordance with the invention.

Referring to FIG. 1, the bias unit comprises an elongate main body structure 10 provided at its upper end with a tapered externally threaded pin 11 for coupling the unit to a drill collar, incorporating a control unit, for example a roll stabilised instrument package, which is in turn connected to the lower end of the drill string. The lower end 12 of the body structure is formed with a tapered internally threaded socket shaped and dimensioned to receive the standard form of tapered threaded pin on a drill bit. In the aforementioned British Patent Specification No. 2259316 the exemplary arrangements described and illustrated incorporate the modulated bias unit in the drill bit itself. In the arrangement shown in the accompanying drawings the bias unit is separate from the drill bit and may thus be used to effect steering of any form of drill bit which may be coupled to its lower end.

There are provided around the periphery of the bias unit, towards its lower end, three equally spaced hydraulic actuators 13, the operation of which will be described in greater detail below. Each hydraulic actuator 13 is supplied with drilling fluid under pressure through a passage 14 under the control of a rotatable disc valve 15 located in a cavity 16 in the body structure of the bias unit.

Drilling fluid delivered under pressure downwardly through the interior of the drill string, in the normal manner, passes into a central passage 17 in the upper part of the bias unit and flows outwardly through a cylindrical filter screen 100 into a surrounding annular chamber 101 formed in the surrounding wall of the body structure of the bias unit. The filter screen 100, and an imperforate tubular element 102 immediately below it, are supported by an encircling spider 103 within the annular chamber 101. Fluid flowing downwardly past the spider 103 to the lower part of the annular chamber 101 flows through an inlet 19 into the upper end of a vertical multiple choke unit 20 through which the drilling fluid is delivered downwardly at an appropriate pressure to the cavity 16.

The disc valve 15 is controlled by an axial shaft 21 which is connected by a coupling 22 to the output shaft (not shown) of the aforementioned control unit (also not shown) in a drill collar connected between the pin 11 and the lower end of the drill string.

The control unit may be of the kind described and claimed in British Patent Specification No. 2257182.

During steered drilling, the control unit maintains the shaft 21 substantially stationary at a rotational orientation which is selected, either from the surface or by a downhole computer program, according to the direction in which the bottom hole assembly, including the bias unit and the drill bit, is to be steered. As the bias unit 10 rotates around the stationary shaft 21 the disc valve 15 operates to deliver drilling fluid under pressure to the three hydraulic actuators 13 in succession. The hydraulic actuators are thus operated in succession as the bias unit rotates, each in the same rotational position so as to displace the bias unit laterally away from the position where the actuators are operated. The selected rotational position of the shaft 21 in space thus determines the direction in which the bias unit is laterally displaced and hence the direction in which the drill bit is steered.

The hydraulic actuators will now be described in greater detail with particular reference to FIG. 2.

Figure 2:
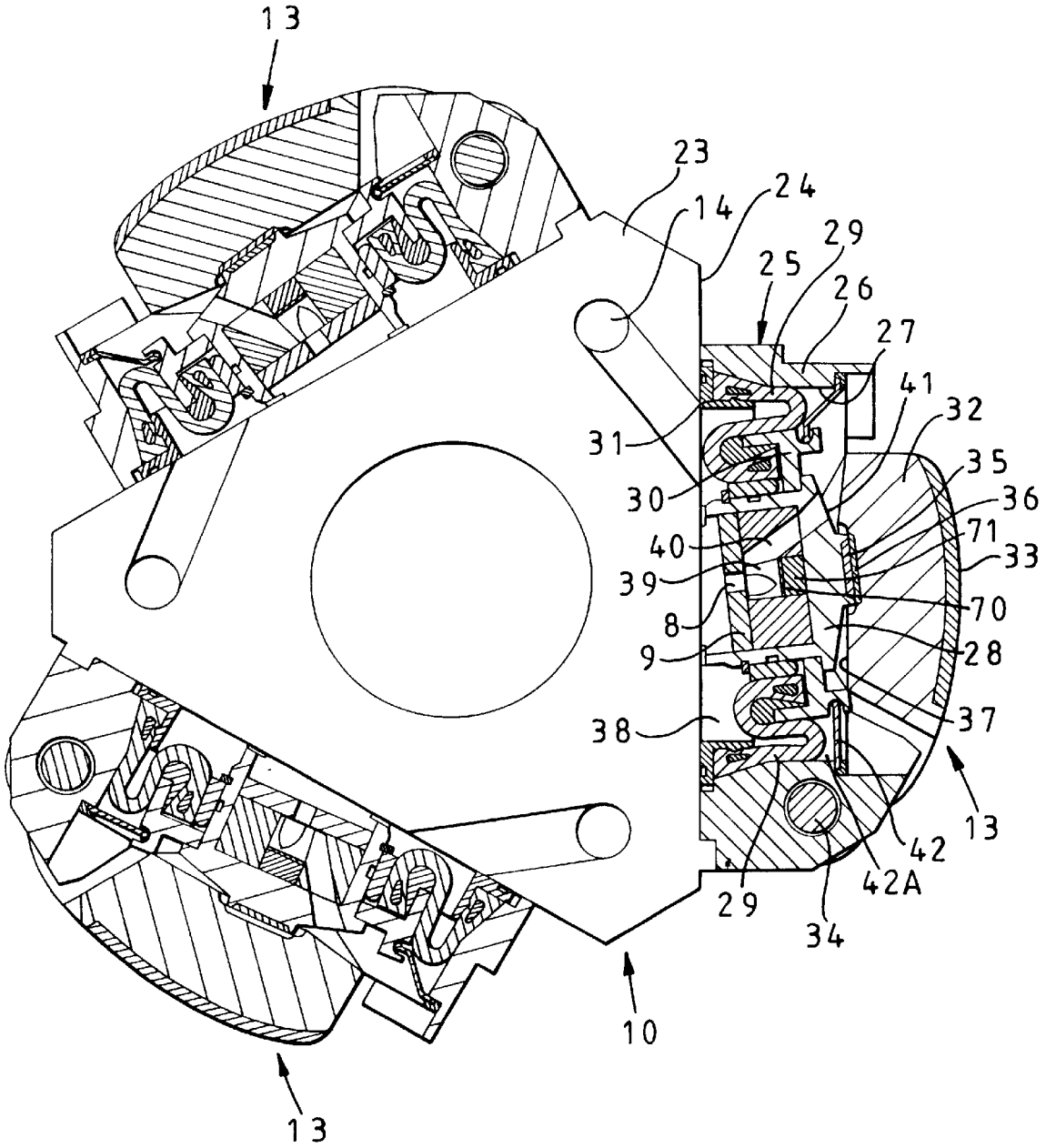
FIG. 2 is a horizontal cross-section through the bias unit, taken along the line 2—2 of FIG. 1.

Referring to FIG. 2: at the location of the hydraulic actuators 13 the body structure 10 of the bias unit comprises a central core 23 of the general form of an equilateral triangle so as to provide three outwardly facing flat surfaces 24.

Mounted on each surface 24 is a rectangular support unit 25 formed with a circular peripheral wall 26 which defines a circular cavity 27. A movable thrust member 28 of generally cylindrical form is located in the cavity 27 and is connected to the peripheral wall 26 by a fabric-reinforced elastomeric annular rolling diaphragm 29. The inner periphery of the diaphragm 29 is clamped to the thrust member 28 by a clamping ring 30 and the outer periphery of the rolling diaphragm 29 is clamped to the peripheral wall 26 by an inner clamping ring 31. The diaphragm 29 has an annular portion of U-shaped cross-section between the outer surface of the clamping ring 30 and the inner surface of the peripheral wall 26.

If the rolling diaphragm 29 were to be exposed to the flow of drilling fluid in the annulus, solid particles in the drilling fluid would be likely to find their way between the diaphragm 29 and the surfaces of the members 26 and 30 between which it rolls, leading to rapid abrasive wear of the diaphragm. In order to prevent debris in the drilling fluid from abrading the rolling diaphragm 29 in this manner, a protective further annular flexible diaphragm 42 is connected between the clamping ring 30 and the peripheral wall 26 outwardly of the rolling diaphragm 29. The flexible diaphragm 42 may be fluid permeable so as to permit the flow of clean drilling fluid into and out of the annular space 42A between the diaphragms 29 and 42, while preventing the ingress of solid particles and debris into that space.

Instead of the diaphragm 42 being fluid permeable, it may be impermeable and in this case the space 42A between the diaphragm 42 and the rolling diaphragm 29 may be filled with a flowable material such as grease. In order to allow for changes in pressure in the space between the diaphragms, a passage (not shown) may extend through the peripheral wall 26 of the support unit 25, so as to place the space between the diaphragms 42, 29 into communication with the annulus between the outer surface of the bias unit and the surrounding borehole. In order to inhibit escape of grease through such passage, or the ingress of drilling fluid from the annulus, the passage is filled with a flow-resisting medium, such as wire wool or similar material.

Each rectangular support unit 25 may be secured to the respective surface 24 of the core unit 23 by a number of screws. Since all the operative components of the hydraulic actuator, including the pad 32, thrust member 28 and rolling diaphragm 29, are all mounted on the unit 25, each hydraulic actuator comprises a unit which may be readily replaced in the event of damage or in the event of a unit of different characteristics being required.

A pad 32 having a part-cylindrically curved outer surface 33 is pivotally mounted on the support unit 25, to one side of the thrust member 28 and cavity 27, by a pivot pin 34 the longitudinal axis of which is parallel to the longitudinal axis of the bias unit. The outer surface of the cylindrical thrust member 28 is formed with a shallow projection having a flat bearing surface 35 which bears against a flat bearing surface 36 in a shallow recess formed in the inner surface of the pad 32. The bearing surfaces 35 and 36 are hardfaced.

The part of the cavity 27 between the rolling diaphragm 29 and the surface 24 of the central core 23 defines a chamber 38 to which drilling fluid under pressure is supplied through the aforementioned associated passage 14 when the disc valve 15 is in the appropriate position. When the chamber 38 of each hydraulic unit is subjected to fluid under pressure, the thrust member 28 is urged outwardly and by virtue of its engagement with the pad 32 causes the pad 32 to pivot outwardly and bear against the formation of the surrounding borehole and thus displace the bias unit in the opposite direction away from the location, for the time being, of the pad 32. As the bias unit rotates away from the orientation where a particular hydraulic actuator is operated, the next hydraulic actuator to approach that position is operated similarly to maintain the displacement of the bias unit in the same lateral direction. The pressure of the formation on the previously extended pad thus increases, forcing that pad and associated thrust member 28 inwardly again. During this inward movement fluid is expelled from the chamber 38 through a central choke aperture 8 formed in a plate 9 mounted on the thrust member 28, the aperture 8 communicating with a cavity 39. Three circumferentially spaced diverging continuation passages 40 lead from the cavity 39 to three outlets 41 respectively in the outwardly facing surface of the thrust member 28, the outlets being circumferentially spaced around the central bearing surface 35.

Drilling fluid flowing out of the outlets 41 washes over the inner surface 37 of the pad 32 and around the inter-engaging bearing surfaces 35 and 36 and thus prevents silting up of this region with debris carried in the drilling fluid which is at all times flowing past the bias unit along the annulus. The effect of such silting up would be to jam up the mechanism and restrict motion of the pad 32.

The aperture 9 in the plate 8 mounted on the thrust member 28 acts as a choke which causes a substantial drop in fluid pressure. The closed end of the cavity 39 acts as an impingement surface against which the drilling fluid flowing at high velocity through the aperture 9 impinges before being diverted through the angled continuation passages 40.

In order to withstand the high pressure impingement of the abrasive drilling fluid, the impingement surface at the end of the cavity 39 is provided by the polycrystalline diamond facing table 70 of a circular polycrystalline diamond compact 71 which is received and retained within the end of the cavity 39. The provision of the impingement surface allows the cavity to be smaller than would otherwise be the case, and thus provides a choke device which will fit within the limited space available within the thrust member 28.

The compact 71 is an element of a kind which is commonly used as a cutting element in a polycrystalline diamond drag-type drill bit. As is well known, such compacts comprise a facing table of polycrystalline diamond which is bonded to a substrate of less hard material, usually cemented tungsten carbide, in a high pressure, high temperature press.

The choke device provided by the aperture 9, the cavity 39 and impingement surface 70 may also be more widely applicable as a choke device in other circumstances where it is required to effect a substantial drop in fluid pressure in a region where space is severely restricted. The provision of the polycrystalline diamond impingement surface allows rapid deceleration of the fluid flow without resulting in the rapid erosion of the impingement surface which would otherwise occur. Although the use of polycrystalline diamond is preferred, since polycrystalline diamond compacts are readily available, the impingement surface may be formed from any other suitable superhard material, such as cubic boron nitride or amorphous diamond-like carbon (ADLC).

FIGS. 3–6 show further applications of the choke device according to the invention.

Figure 3:
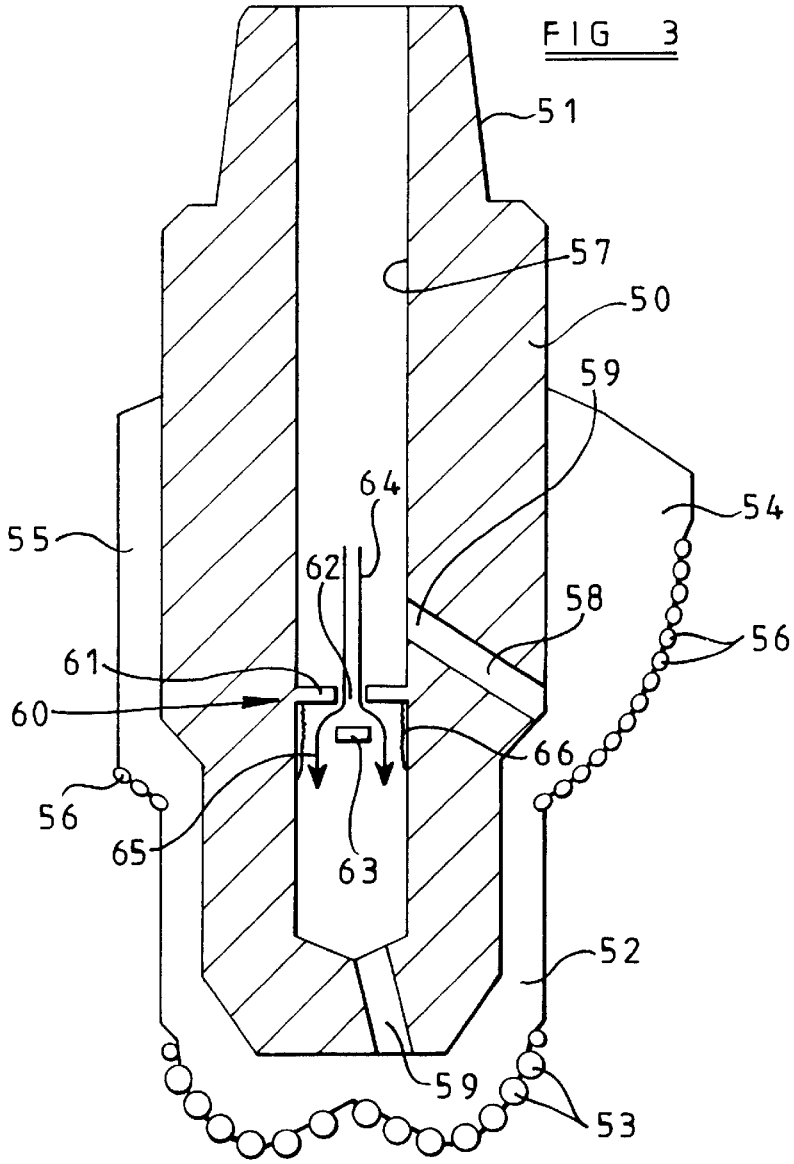
FIG. 3 is a diagrammatic longitudinal section through a drag-type drill bit incorporating a choke device in accordance with the invention.

Referring to FIG. 3, there is shown in longitudinal cross-section a drag-type rotary drill bit for drilling holes in subsurface formations. The drill bit comprises a bit body 50 provided at one end with a tapered externally threaded pin 51 for connecting the bit to a drill string. The lower end of the bit body is formed with a plurality of blades 52 which extend outwardly from the central longitudinal axis of the bit and upstand from the end face of the bit body.

Spaced side-by-side along each blade are a plurality of cutters 53. The cutters comprise polycrystalline diamond compacts of generally circular form comprising a front facing cutting table of polycrystalline diamond, or other superhard material, bonded to a less hard substrate, for example of cemented tungsten carbide. The structure of such cutters is well known in the art and will not be described in further detail.

The bit is a bi-centre bit of asymmetrical construction so that the bit may be passed through a bore which is of smaller diameter than the bore which the bit itself actually drills. For this purpose the bit comprises further, upper blades 54, 55 in the form of upward extensions of the blades 52, each of the upper blades carrying further cutters 56 which may be of similar form to the cutters 53.

However, while the blade 54 at one side of the bit has a radius such that it will cut a borehole of the full required diameter, the other upper blades are of decreasing radius as they extend away from the blade 54, the blade 55 being of minimum radius, as shown. It will thus be seen that the overall maximum cross-dimension of the bit is less than twice the radius of the biggest blade 54, which corresponds to the diameter of the borehole which the bit will drill. The bit may therefore be passed along a bore which is smaller than this diameter. During drilling the bit is stabilised, so as to rotate about its central longitudinal axis, by the cutters 53 on the lower, generally symmetrical blades 52. These cutters drill a smaller diameter pilot bore, the following blades 54, 55 and cutters 56 drilling a larger main bore which is coaxial with the pilot bore.

In known manner, drilling fluid for cooling and cleaning the cutters, and for carrying cut chips of formation to the surface, is pumped down the drill string from the surface and through a central internal passage 57 in the bit body. Subsidiary passages 58, 59 lead from the main passage 57 to deliver drilling fluid to nozzles at the surface of the bit body which in turn deliver the drilling fluid under pressure to the cutters 56 and 53 respectively.

In order to ensure that an adequate proportion of the drilling fluid flowing downwardly along the main passage 15 flows along the first subsidiary passage 58 to the cutters 56, it is necessary to locate a choke device in the main passage 57 downstream of the entry 59 into the subsidiary passage 58. The choke device, indicated generally at 60 is in accordance with the invention.

The choke device comprises a wall 61 which extends across the main passage 57 downstream of the inlet 59 and is formed with a circular choke aperture 62. Mounted in the centre of the passage 57 a short distance downstream of the choke aperture 62 is a circular polycrystalline diamond compact 63. The compact 63 comprises a front facing table of polycrystalline diamond, or other superhard material, which faces the aperture 62 and is bonded to a substrate of cemented tungsten carbide or other less hard material. As in the previously described arrangement, the compact 63 may be an element of the kind which is commonly used as a cutting element in polycrystalline diamond drag-type drill bits.

In use, drilling fluid flowing under pressure downwardly through the passage 57, as indicated at 64, passes through the choke aperture 62 and impinges on the superhard facing surface of the compact 63, before being diverted outwardly to flow around the compact 63, as indicated at 65. The choke device effects the required pressure drop to ensure that a proportion of the drilling fluid above the choke device will flow through the subsidiary passage 58. The provision of the polycrystalline diamond or other superhard material impingement surface allows rapid deceleration of the fluid flow, and consequent pressure drop, in a very small space.

The compact 63 may be supported within the passage 57 by any suitable structure which will permit the flow of drilling fluid downwardly around the compact. For example, the compact may be mounted at the centre of a spider having arms which extend to the surrounding walls of the passage 57, or may be suspended from the wall 61 by a suitable apertured structure.

In order to prevent erosion and abrasion of the internal walls of the passage 57 in the vicinity of the compact 63, the walls in this region may have a lining or coating of polycrystalline diamond, tungsten carbide or other hard material, as indicated diagrammatically at 66.

Figure 4:
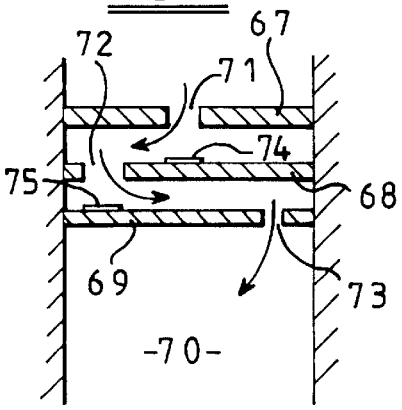
FIGS. 4–6 are diagrammatic sections on an enlarged scale showing further forms of choke device.

Instead of only a single choke device to provide the required pressure drop, there may be provided a succession of choke devices according to the invention arranged along a passage, such as the passage 57, and such an arrangement is shown in FIG. 4.

In this case there are provided a number of walls 67, 68, 69 (in this case three walls) extending across the passage 70. The walls are formed with choke apertures 71, 72, 73 respectively, each aperture being spaced laterally with respect to the choke aperture in an adjacent wall, so that fluid flow from one choke aperture to the next necessitates flow in a direction having a lateral component.

The wall 68 provides an impingement surface 74 of superhard material opposite the choke aperture 71, and the wall 69 provides an impingement surface 75 opposite the choke aperture 72. An impingement surface may also be provided opposite the choke aperture 73 if required.

Each impingement surface may comprise a layer of polycrystalline diamond or other superhard material applied directly to the surface of the wall itself or may comprise the superhard facing table of a two-layer diamond compact which is either mounted on the surface of the wall, or is recessed into it.

Figure 5:
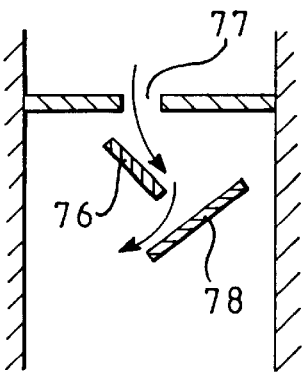

In the arrangements described above the impingement surface in the choke device extends generally at 90° to the direction of flow of fluid through the associated choke aperture. FIG. 5 shows an alternative arrangement where a polycrystalline diamond compact 76 is inclined at less than 90° to the direction of flow of fluid through its associated choke aperture 77. In this case a further polycrystalline diamond compact 78, providing a further impingement surface, is located downstream of the compact 76 and is oppositely inclined so that fluid impinging on the impingement surface provided by the compact 76 is deflected laterally thereby onto the succeeding impingement surface provided by the compact 78.

Figure 6:
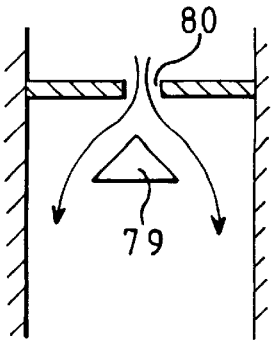

Instead of the impingement surface of the choke device being substantially planar, as in the above described arrangements, it may be shaped to provide a central region which is nearest the associated choke aperture, and surrounding regions which extend in the downstream direction away from the central region. For example, the polycrystalline diamond or other superhard surface may be formed, as shown in FIG. 6, on a substantially part conical substrate 79, the apex of the conical compact facing towards the associated choke aperture 80.

Whereas the present invention has been described in particular relation to the drawings attached hereto, it should be understood that other and further modifications, apart from those shown or suggested herein, may be made within the scope and spirit of the present invention.

What is claimed:

1. A choke device for controlling fluid flow, comprising a passage for the flow of fluid, a choke aperture separating an upstream portion of the passage from a downstream portion thereof, and an impingement surface located in the downstream portion of the passage opposite and spaced from the choke aperture, whereby fluid flowing through the choke aperture impinges on the impingement surface, the impingement surface being formed from superhard material.

2. A choke device according to claim 1, wherein the impingement surface is substantially flat.

3. A choke device according to claim 1, wherein the impingement surface is of generally corresponding shape to the choke aperture.

4. A choke device according to claim 3, wherein the choke aperture and impingement surface are both generally circular.

5. A choke device according to claim 1, wherein the impingement surface extends generally at 90° to the direction of flow of fluid through the choke aperture.

6. A choke device according to claim 1, wherein the impingement surface is inclined at less than 90° to the direction of flow of fluid through the choke aperture.

7. A choke device according to claim 1, wherein the impingement surface is shaped to provide a central region which is nearest the choke aperture, and surrounding regions which extend in the downstream direction away from the central region.

8. A choke device according to claim 7, wherein the impingement surface is substantially part-conical.

9. A choke device according to claim 6, wherein there are provided a plurality of impingement surfaces spaced apart in the downstream direction and oppositely inclined to the direction of flow of fluid so that fluid impinging on one impingement surface is deflected laterally thereby onto a succeeding impingement surface.

10. A choke device according to claim 1, wherein the passage for the flow of fluid includes a plurality of choke apertures spaced apart along the passage, an impingement surface being spaced downstream from each choke aperture.

11. A choke device according to claim 10, wherein each choke aperture is displaced laterally with respect to an adjacent choke aperture, whereby fluid flow from one choke aperture to the next necessitates flow in a direction having a lateral component.

12. A choke device according to claim 1, wherein the superhard material is selected from polycrystalline diamond, cubic boron nitride and amorphous diamond-like carbon.

13. A choke device according to claim 1, wherein the impingement surface is provided by a polycrystalline diamond compact comprising a front table of polycrystalline diamond bonded to a substrate of less hard material, the compact being so located and orientated downstream of the choke aperture that the front table thereof provides said impingement surface opposite the choke aperture.

14. A choke device according to claim 1, wherein the internal surface of the passage downstream of the choke aperture, and in the vicinity of the impingement surface, is lined with an abrasion- or erosion-resistant material.

15. A choke device according to claim 14, wherein the abrasion- or erosion-resistant material is selected from polycrystalline diamond and tungsten carbide.

16. A rotary drill bit for drilling holes in subsurface formations, comprising a main bit body carrying a plurality of cutters for cutting the formation being drilled, and at least one internal passage in the bit body to convey drilling fluid to the cutters, said internal passage incorporating a choke device including a choke aperture separating an upstream portion of the passage from a downstream portion thereof, and an impingement surface located in the downstream portion of the passage opposite and spaced from the choke aperture, whereby fluid flowing through the choke aperture impinges on the impingement surface, the impingement surface being formed from superhard material.

17. A rotary drill bit according to claim 16 wherein there is provided a main internal passage in the bit body, and a plurality of subsidiary passages leading from the main passage to convey drilling fluid to cutters on the bit body, the choke device being located in the main passage downstream of at least one subsidiary passage.

* * * * *